US005108037A

United States Patent [19]

Okamoto et al.

[11] Patent Number: 5,108,037

[45] Date of Patent: Apr. 28, 1992

[54] FUEL INJECTION VALVE

[75] Inventors: Yoshio Okamoto; Haruo Watanabe, both of Tsuchiura; Hiroyuki Ando, Katsuta; Youzou Nakamura, Katsuta; Mineo Kashiwaya, Katsuta; Eiji Hamashima, Katsuta, all of Japan

[73] Assignees: Hitachi Ltd., Chiyoda; Hitachi Automotive Engineering Co., Ltd., Ibaraki, both of Japan

[21] Appl. No.: 491,116

[22] Filed: Mar. 9, 1990

[30] Foreign Application Priority Data

Mar. 10, 1989 [JP] Japan ..... 1-56095

[51] Int. Cl.[5] ..... F02M 61/00; B05B 1/30

[52] U.S. Cl. ..... 239/473; 239/585.4; 239/585.5; 239/533.12; 239/900

[58] Field of Search ..... 239/533.12, 533.2, 533.3, 239/585, 478, 477, 472–473

[56] References Cited

U.S. PATENT DOCUMENTS

| | | | |
|---|---|---|---|
| 2,775,484 | 12/1956 | Fox | 239/533.2 X |
| 2,920,831 | 1/1960 | Johnsyn, Jr. | 239/533.2 X |
| 3,241,768 | 3/1966 | Croft | 239/533.12 X |
| 3,406,910 | 10/1968 | Simmons | 239/533.2 X |
| 4,192,466 | 3/1980 | Tanasawa et al. | 239/533.12 X |
| 4,266,727 | 5/1981 | Happel et al. | 239/533.12 X |
| 4,403,741 | 9/1983 | Moriya et al. | 239/585 |
| 4,564,145 | 1/1986 | Takada et al. | 239/533.3 X |

FOREIGN PATENT DOCUMENTS

| | | | |
|---|---|---|---|
| 1151317 | 4/1985 | U.S.S.R. | 239/478 |

*Primary Examiner*—Andres Kashnikow
*Assistant Examiner*—Lesley D. Morris
*Attorney, Agent, or Firm*—Ladas & Parry

[57] ABSTRACT

A fuel injection valve (10) has a valve member (2) arranged to be controllably movable in an axial direction toward and away from a circular valve seat (4) so as to control fuel flow from a port (5) downstream from the valve seat. An axial fuel passage (7) extends from upstream of the valve seat (4) through a clearance between the seating portion and the seat (4) for producing a substantially non-swirling fuel flow from the port (5). A transverse fuel passage (8) is also provided and the transverse fuel passage extends transversely to the axial passage and communicates with the axial fuel passage at a location offset to a diameter of the valve seat for producing a swirling fuel flow from the port (5). A combination of swirling and non-swirling fuel flow is thus supplied by the port (5), for producing finer fuel droplets of improved distribution.

21 Claims, 6 Drawing Sheets

FIG. 5
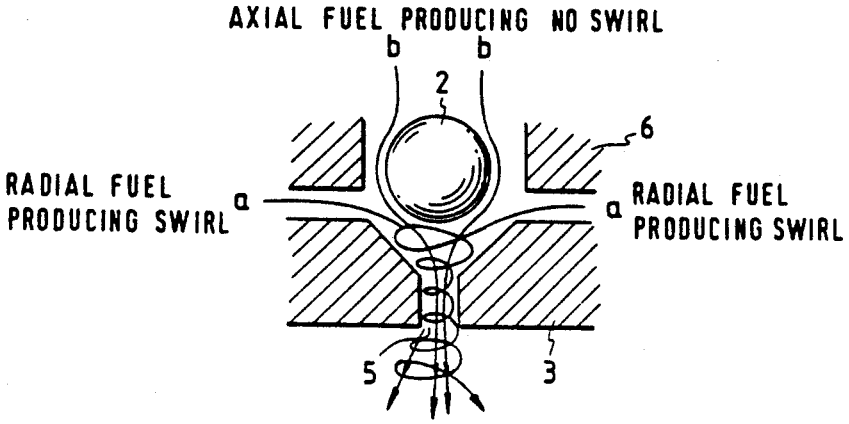
FIG. 6(a)
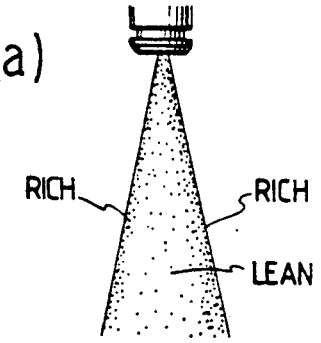
FIG. 7(a)
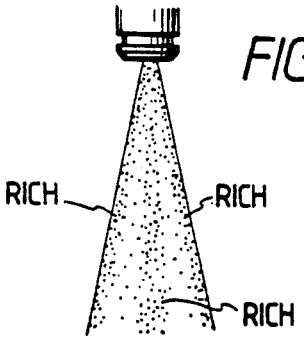
FIG. 6(b)
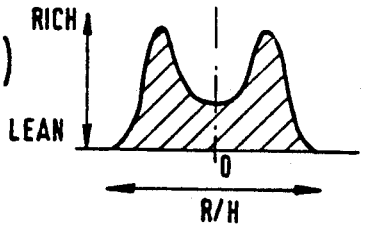
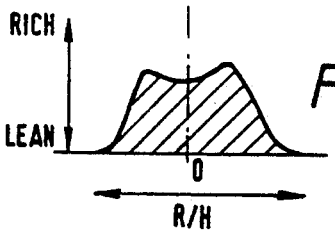
FIG. 7(b)

FUEL INJECTION VALVE

BACKGROUND OF THE INVENTION

1. Field of the Invention

This invention relates to a fuel injection valve and in particular, although not exclusively, to a fuel injection valve for an internal combustion engine, such valves may be actuated, for example, electro-mechanically, mechanically or hydraulically.

2. Description of the Related Art

One known electro-magnetic fuel injection valve has a reciprocal ball valve and fuel is supplied to the ball valve in the axial direction of reciprocation. Such a valve tends to provide a non-uniform distribution of fuel drops.

Another known electro-magnetic fuel injection valve has a structure wherein a fuel is swirled at an upstream side of an injection hole and such a valve is known to produce finer fuel drops but they are still unacceptably non-uniform. A known injection valve is disclosed in Japanese Patent Application Laid-Open No. 56-75955 (1981). In such a conventional injection valve, a swirl plate has a guide hole for receiving a ball and a swirl passage for introducing fuel to the guide hole in a substantially tangential direction.

In the above prior art injection valve, the spray from the injection guide hole spreads in a conical shape and produces large size drops and the drop distribution near the valve axial center is reduced. However, previously, no consideration has been given to such a problem.

The present invention seeks to provide a fuel injection valve having a uniform distribution of fuel spray and drop size.

SUMMARY OF THE INVENTION

According to one aspect of this invention there is provided a fuel injection valve having a valve seat upstream from an injection port, a reciprocal valve member for contacting said seat to open and close said injection port, an axial fuel passage in the direction of reciprocation for producing substantially non-swirling fuel to the injection port, and a transverse passage for introducing swirling fuel to the injection port, whereby the swirling and non-swirling fuel is injected by the injection port.

Preferably the direction of reciprocation has a longitudinal axis and a transverse axis perpendicular to said longitudinal axis, and the transverse passage is offset from said transverse axis.

According to a feature of this invention there is provided a fuel injection valve including a valve member having a seating portion arranged to be controllably movable in an axial direction toward and away from a circular valve seat for controlling fuel flow from a port downstream of said valve seat, a generally axial fuel passage extending from upstream of the valve member through a clearance between said seating portion and said seat for producing a substantially non-swirling fuel flow from said port, and a transverse fuel passage extending transversely to said axial direction and communicating with said axial fuel passage at a location offset to a diameter of the valve seat for producing a swirling fuel flow from said port, whereby a combination of swirling and non-swirling fuel flow is supplied by said port.

In a currently preferred embodiment the transverse fuel passage is upstream from the valve seat. In such an embodiment advantageously said transverse fuel passage communicates with said axial fuel passage at a spaced upstream location from said valve seat.

Conveniently four equi-peripherally spaced transverse fuel passages are provided. Advantageously the valve member is circular in cross-section, an annular clearance is provided between the valve member and a body member upstream from said seat, and the cross-sectional area of the transverse fuel passage is arranged to be greater than the cross-sectional area of the annular clearance. Preferably $1.5 < Am/Ag < 6.0$. and advantageously the distance of offset of the transverse fuel passage is in the range 0.5 mm to 1.0 mm.

The valve member may be a needle valve or a ball valve and the valve member may be actuable by an electro-magnetic coil assembly.

By providing a combination of an axial direction flow component of fuel and a radial direction flow component, the injection flow amount is stabilised.

Moreover, by a proper allocation of the non-swirling fuel amount which flows through the annular clearance around the valve member, uniformity of spray, and drop size is produced.

Thus, generation of large size drops is supressed, quality of the fuel mixture supplied to the internal combustion engine is improved and operation of the engine is stabilised.

BRIEF DESCRIPTION OF THE DRAWINGS

The invention will now be described by way of example with reference to the accompanying drawings in which:

FIG. 5 is a diagram illustrating the fuel flow state around the ball valve;

FIGS. 6(*a*) and 6(*b*) schematically illustrate an observed result of a spray with the conventional nozzle portion;

FIGS. 7(*a*) and 7(*b*) schematically illustrate an observed result of a spray with a nozzle of the present invention;

In the Figures like reference numerals denote like parts.

DESCRIPTION OF THE PREFERRED EMBODIMENT

Initially, the construction of the nozzle portion of a ball valve type electro-magnetic fuel injection valve will be explained with reference to FIG. 1.

Figure 1:
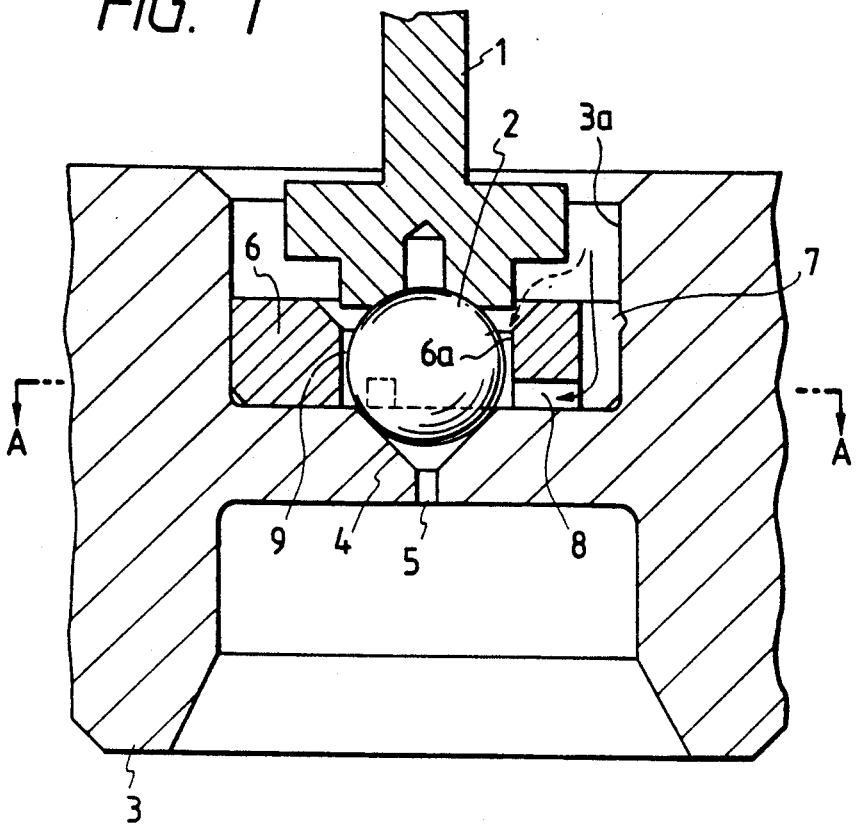
FIG. 1 is an enlarged cross-sectional view of a nozzle portion of a ball valve type electro-magnetic fuel injection valve according to this invention.

In FIG. 1 a ball valve is formed by a reciprocal rod 1, one end of which is attached to a ball 2, the ball cooperating with a seat 4 in a nozzle body 3. On the downstream side of the seat 4 is a fuel injection nozzle port 5, the port 5 being opened and closed by reciprocation of the ball 2 away from and onto the seat 4, whereby fuel metering is effected.

A circularly cross-sectioned fuel element 6 is disposed in a chamber 3*a* of a body 3 at the upstream side of the seat 4 for applying a swirling force to the fuel supplied to the nozzle, the element 6 including an axial direction channel 7 and an interconnected radial direction channel 8. An annular clearance 9 is formed between an inner wall surface 6*a* of the fuel swirling element 6 and the ball 2.

When the ball 2 is lifted from the seat 4 of the nozzle body 3, the fuel flows from the upper part of the drawing to the fuel injection nozzle port 5. During this time, the amount of fuel is divided into a flow (shown by a solid arrow-headed line) through the axial direction channel 7 and the radial direction channel 8 of the element 6, and another flow (shown by a broken arrow-headed line) through the annular clearance 9 formed between the inner wall surface 6*a* of the fuel element 6 and the ball 2.

Figure 2:
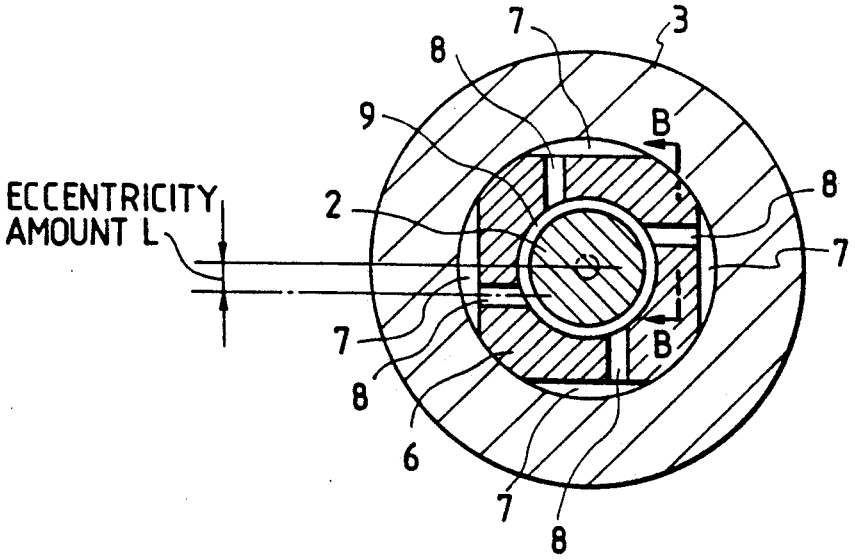
FIG. 2 is a cross-sectional view taken along the double arrow-headed line A—A of FIG. 1.

FIG. 2 shows a cross-sectional view taken along the line A—A of FIG. 1 and illustrates the axial direction channel 7 and the radial direction channel 8 of the fuel element 6.

The axial direction channel 7 is formed through a D shaped aperture as shown in FIG. 2, and the radial direction channel 8 joins to the axial direction channel 7 and is formed to be eccentric (the amount of eccentricity L is about 0.5 mm to 1.0 mm) with respect to the valve axial center.

Thus, the fuel passing through the axial direction channel 7 is eccentrically introduced with respect to the valve axial center by the radial direction channel 8, thereby a swirling force is applied to the fuel and vaporization of the fuel is enhanced when the fuel is injected from the fuel injection port 5.

Figure 3:
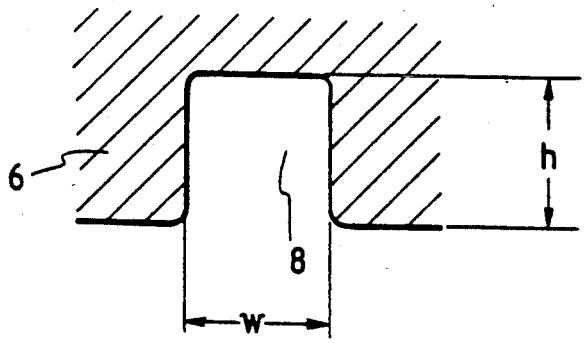
FIG. 3 is an enlarged cross-sectional view taken along the double arrow-headed line B—B of FIG. 2.

FIG. 3 shows a cross-sectional view taken along the line B—B of FIG. 2 and illustrates the channel shape of the radial direction channel 8.

The radial direction channel 8 is a channel of a rectangular cross-sectional shape having a channel width w and a channel depth h. A plurality of the radial direction channels 8 are provided, which, as shown in FIG. 2 of this exemplary embodiment, are four in number.

The construction and operation of the nozzle portion shown in FIG. 1 will now be explained with reference to the electro-magnetic fuel injection valve shown in FIG. 4.

Figure 4:
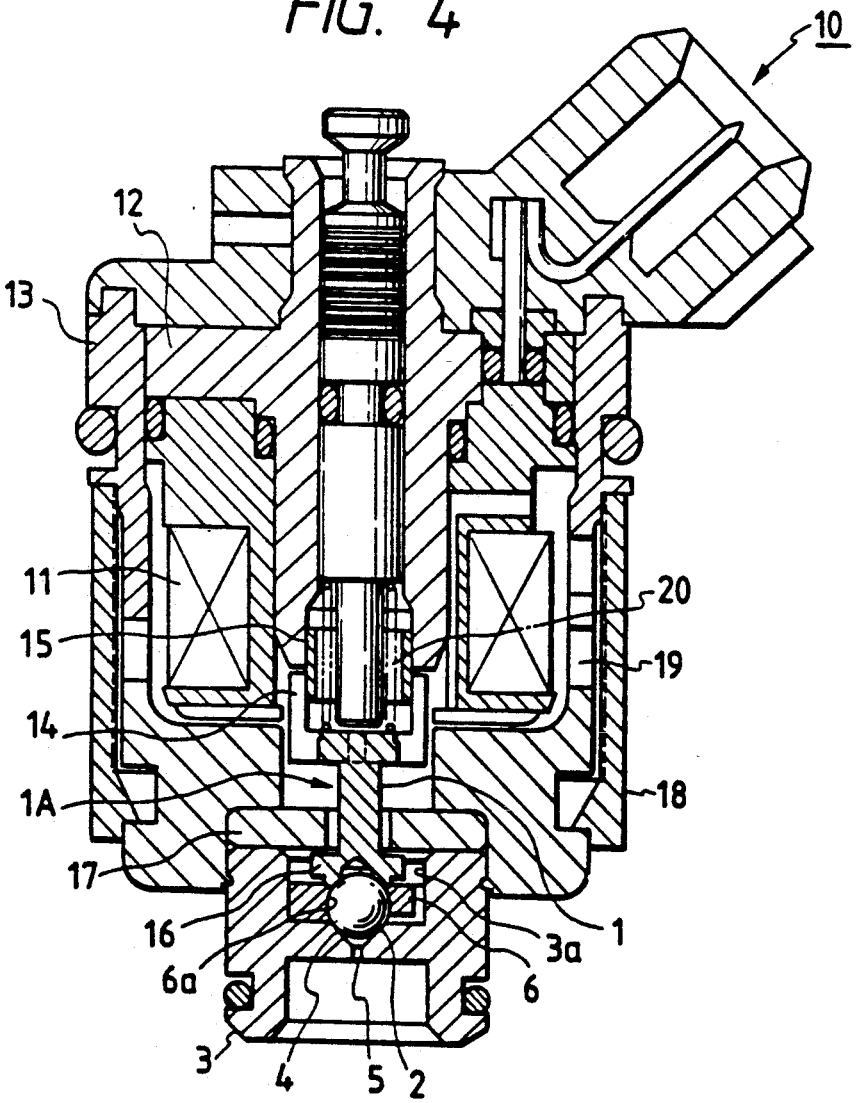
FIG. 4 is a vertical cross-sectional view of the electro-magnetic fuel injection valve including the nozzle portion of FIG. 1.

The electro-magnetic fuel injection valve 10 as shown in FIG. 4 performs fuel injection through opening and closing the seat in response to ON-OFF duty signals which are calculated by a control unit (not shown).

When a current flows through a magnetic coil 11 which constitutes the electro-magnetic assembly, a magnetic circuit is formed through a core 12, a yoke 13 and a plunger 14 which are formed by a magnetizable material such as stainless steel, and the plunger 14 is pulled toward the core 12. When the plunger 14 moves, the ball valve 1A integral therewith lifts and leaves the seat 4 in the valve body 3 to open the fuel injection port 5.

The ball valve 1A is formed by the rod 1 connected to one end of a plunger 14, formed of a magnetic material, the ball 2 being welded to the other end of the rod 1, and a guide ring 15 of non-magnetic material fixed at the upper opening portion of the plunger 14. The movement of plunger 14 is guided by the guide ring 15 and the inner wall surface 6*a* of the fuel element 6 inserted and fixed in the hollow chamber 3*a* of the valve body 3. Thus the ball valve is guided at its extreme ends and slidably moves in an axial direction, wherein the operating stroke thereof is determined by a gap between a receiving surface at the neck portion of the rod 1 and a horseshoe-shaped stopper 17.

The fuel is pressurized and adjusted by a fuel pump and a fuel pressure regulator, both not shown, introduced through a filter 18 to the inside of the injection valve 10 from an inlet passage 19, passes around the outer circumference of the plunger 14 and the gap between the stopper and the rod, through the annular clearance 9 and the axial direction channel 7 and the radial direction channel 8 of the fuel element 6 and is metered by the ball 2 and seat 4 combination to be injected from the fuel injection port 5 toward the intake pipe (not shown) of the internal combustion engine.

When the current to the magnetic coil 11 is removed, the ball valve 1A moves downwardly (as shown in FIG. 4) to the valve seat through bias by a spring 20 and ball 2 closes onto the seat 4.

During the above fuel injection, the amount of the fuel is divided into a flow through the axial direction channel 7 and the radial direction channel 8 of the fuel element 6 and another flow through the annular clearance 9.

Such fuel division is adjusted and determined by the ratio of the total cross-sectional area of the radial direction channel 8 and the cross-sectional area of the annular clearance 9 between the ball 2 and the inner wall surface 6*a* of the fuel element 6.

The swirling fuel eccentrically introduced from the radial direction channel of the fuel swirling element 6 increases its swirling speed at the seat 4 of the valve guide and travels to the fuel injection port, such is illustrated by the solid arrow shown in FIG. 1. On the other hand, toward such swirling fuel, non-swirling fuel from the annular clearance between the ball and the inner wall surface 6*a* of the fuel swirling element 6 is supplied and mixed therewith in the region between the seat 4 and the fuel injection port 5.

In FIG. 5, such fuel flow is illustrated, the radial direction flow component (a) flowing in from the radial direction channel of the fuel element 6, producing swirling fuel and the axial direction flow component (b) from the circumference of the ball 2 producing non-swirling fuel.

The cross-sectional area of the annular clearance 9 permitting passage of the non-swirling fuel is made to be smaller than that of the radial direction channel 8 permitting passage of the swirling fuel, the mixture ratio of both is effected under the condition explained herein below.

The cross-sectional area Am of the radial direction channel 8 having width w and depth h is determined by using the hydrodynamic equivalent diameter and is given as follows, $$Am = n \cdot \frac{\pi}{4} \left[ \frac{2wh}{w + h} \right]^2$$

wherein n is the number of channels.

It is preferable to select the ratio (Am/Ag) between this cross-sectional area (Am) and the cross-sectional area (Ag) of the annular gap 9 as follows, $$1.5 < Am/Ag < 6.0.$$

The advantage thereof will be explained below with reference to experimental results.

Figure 10B:
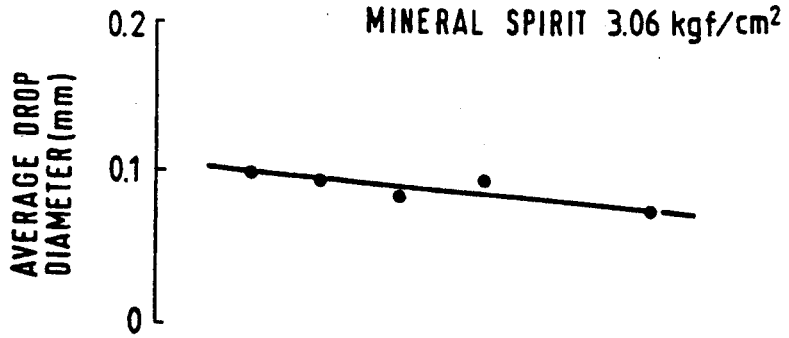
FIGS. 10(*a*) and 10(*b*) are graphical diagrams illustrating the effect of the ratio between the non-swirling fuel and the swirling fuel on amount of static flow.
Figure 10A:
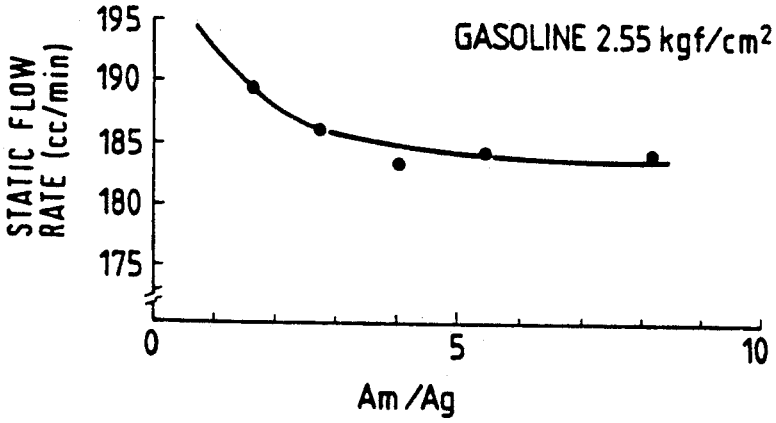

FIGS. 6(*a*) and 6(*b*) illustrate an observed result of a spray with the conventional nozzle portion, FIG. 6(*a*) schematically showing a side view of the nozzle and spray distribution and FIG. 6(*b*) showing in graphical form the mixture at right angles to the spray axial direction. FIGS. 7(*a*) and 7(*b*) are similar to FIGS. 6(*a*) and 6(*b*) but show the observed spray resulting from the nozzle used in this invention. In FIGS. 6(*b*) and 7(*b*) the ordinate is mixture and the abscissa is the ratio R/H where R is the mean diameter of the spray and H is the axial distance from the injector port outlet into the spray at which R is measured. FIG. 10 is a diagram illustrating effects of the ratio between the non-swirling fuel and the swirling fuel at a maximum flow rate for valve at a constant pressure, known as the static flow because the flow quantity cannot thereafter be increased without increasing pressure.

In the conventional type injection valve shown in FIGS. 6(*a*) and 6(*b*), the fuel is lean near the center of the spray and is rich with large drops around the periphery. When the fuel injection path to a cylinder is short such large droplets are difficult to vaporise in the short time available for combustion and thus cause inefficiency in the internal combustion engine. On the other hand, with the injection valve of the present invention as shown in FIG. 7, there is a fuel rich portion near the center as well as the periphery so that a uniform spray is formed.

Figure 8:
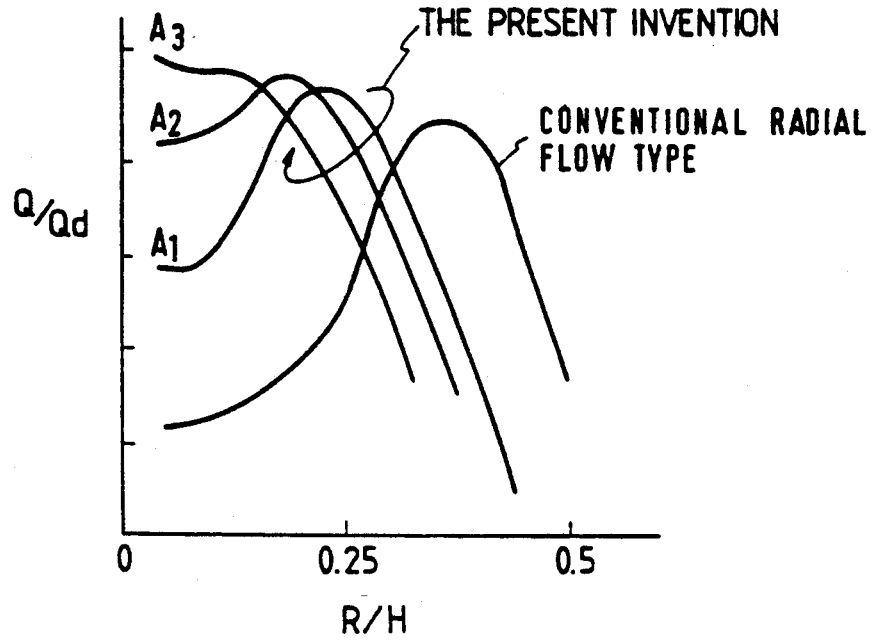
FIG. 8 is a graphical diagram showing variation of spray and drops.

FIG. 8 illustrates variation of spray and drops collected in a plurality of coaxial cylindrical vessels. The ordinate indicates the ration between the total injection amount Q (total flow Q equals axial flow Qd plus radial flow Qr) and the collected amount Qd in a unit time. The abscissa is the ratio R/H.

As apparent from FIG. 8, in the conventional type, the spray is non-dense near the center i.e. toward R/H=O and the drops concentrate at the peripheral portion; however, with the injection valve of the present invention the drop variation concentrated at the peripheral portion of the spray decreases, and contrary to the prior art increases near the central portion and becomes substantially constant over a large area. The curves Al, A2 and A3 indicate increasing injection areas from A1 up to A3.

Figure 9:
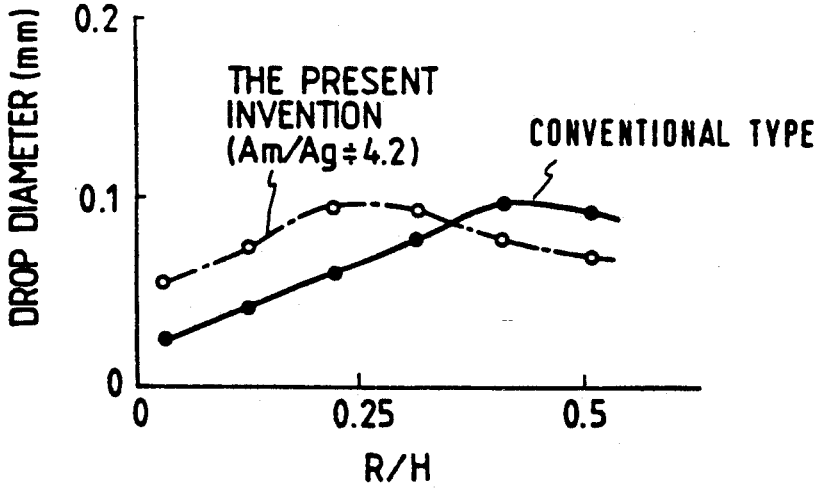
FIG. 9 is a graphical diagram showing drop diameter distribution.

FIG. 9 shows an example of measurement results with respect to the drop diameter distribution. The abscissa is the same scale as the abscissa of FIG. 8 and the ordinate indicates drop diameter (mm).

As apparent from FIG. 9, in the case of the conventional type of injector, near the center, i.e. where R/H is 0 there are many comparatively small drops so that the average drop size is small and the drops of large diameter occur near to the periphery of the spray.

On the other hand, with the injection valve of the present invention the difference between the drop diameters is more nearly constant over a large area extending from near the center to the periphery and the average drop diameter is more uniform.

FIG. 10(*a*) illustrates the effect of the ratio between the non-swirling fuel flowing through the annular clearance 9 around the ball 2 and the swirling fuel flowing through the radial direction channel of the fuel element on the static flow rate. Static flow rate is the maximum flow rate from the valve for a given pressure and is given by $Qs = CA\sqrt{P}$ where Qs is static flow rate, C is a flow coefficient, A is the injection port area, and P is the injection pressure.

In FIGS. 10(*a*) and 10(*b*) the abscissa is the ratio (Am/Ag) between the cross-sectional area Am of the radial direction channel 8 and the cross-sectional area Ag of the annular clearance 9. In FIG. 10(*a*) the ordinate is the static flow rate (cc/min).

In FIG. 10(*a*), when the ratio Am/Ag is more than 1.5, the static flow rate stabilizes and the target accuracy is satisfied; in other words, when values above 1.5 for the ratio Am/Ag are selected then the flow coefficient C becomes substantially constant because $C = Qs/A\sqrt{P}$.

In FIG. 10(*b*) the ordinate is an average diameter of the spray and is seen to be a substantially constant value.

A large number in the ratio of Am/Ag means that the annular clearance 9 becomes small. For example, when Am/Ag is selected to be about 8, the clearance is a few microns, an extremely severe working accuracy to achieve and assembly of the injection valve is rendered difficult.

Therefore the present invention preferably provides an injection valve having Am/Ag below 6, in this case, the annular clearance is about 20 microns so that a required working accuracy is several times more than the conventional type. It is therefore possible to construct a lower price injection valve.

Figure 11:
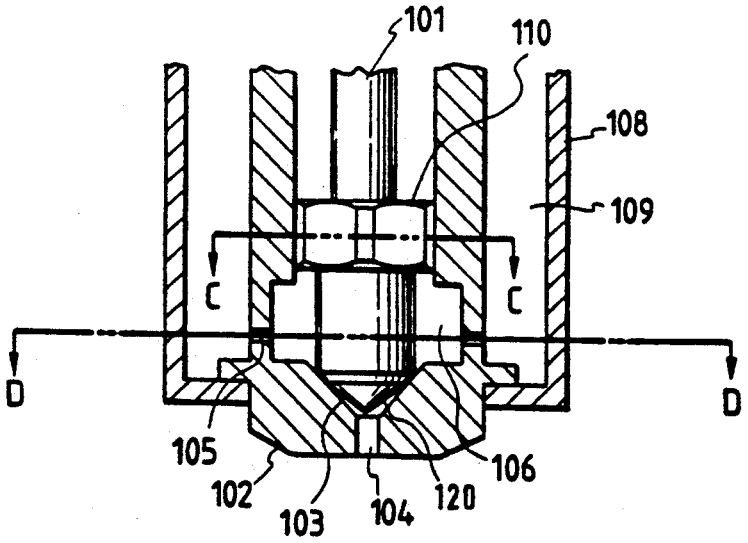
FIG. 11 shows a longitudinal sectional view of part of a nozzle portion of a needle valve type electromagnetic fuel injection valve according to another embodiment of this invention.
Figure 12:
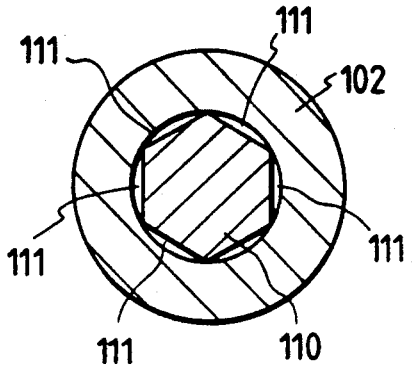
FIG. 12 is a cross-section along double arrow-headed line C—C of FIG. 11.
Figure 13:
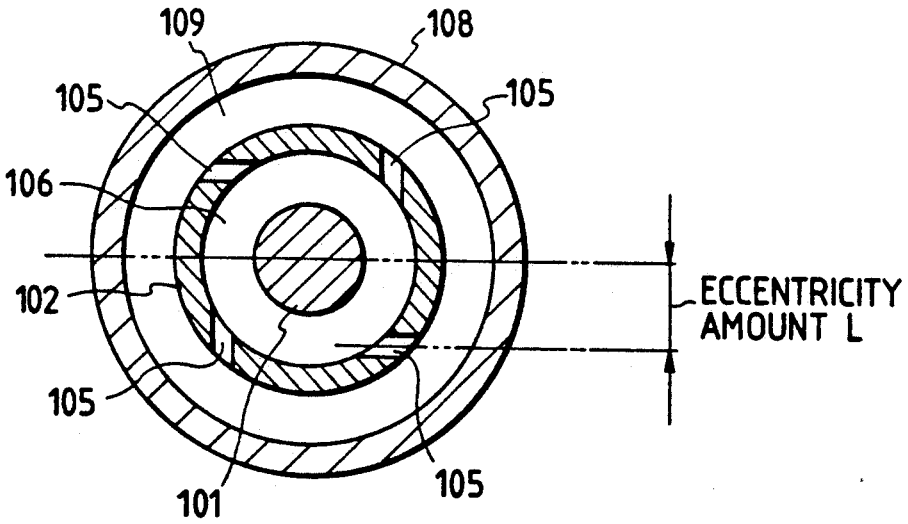
FIG. 13 is a view along double arrow-headed line D—D of FIG. 11.

Another embodiment of the invention will now be described with reference to FIGS. 11-13. This embodiment shows a needle valve type fuel injection valve having a reciprocal rod 101 with a needle 120 at a remote end of the rod 101, the needle 120 being adapted to sealingly locate upon a seat 103 in a nozzle body 102. The nozzle body has a nozzle port 104 which is closable by the needle 120. The nozzle body 102 is cylindrical having a lower radially enlarged fuel circulation chamber 106 and the reciprocal rod 101 is provided with a hexagonal shaped guide 110 for ensuring stable reciprocation of the rod 101 within the internal bore of the nozzle body 102. The clearance formed by the flats of the hexagonal guide 110 provide a clearance 111 between the guide and the internal walls of the body 102 to permit axial flow of fuel. The nozzle body 102 is located in a housing 108 such that a fuel passage 109 is formed between the housing 108 and the cylindrical sides of the nozzle body 102, the housing 108 being sealed to the lower end of the body 102 to prevent leakage of fuel. Four eccentric radial direction channels 105 are provided through the side wall of the nozzle body 102 to communicate the fuel circulation chamber 106 with the fuel passage 109, the radial direction channels being offset from the radial axis of the chamber 106 as shown in FIG. 13.

When the rod 101 is raised so that the needle 120 is lifted from seat 103 fuel passes from fuel passage 109 via radial direction channel 105 and then flows toward the fuel nozzle port 104. At the same time the radially directed fuel is mixed with axial direction fuel passing through clearance 111 so that the axial and radial fuel mixes in chamber 106 and passes through nozzle port 104. By virtue of the radially directed channels 105 being offset by an eccentric dimension L so fuel mixes and circulates in chamber 106. A volumetric distribution of the axial and radial directed fuel is determined as in the above described embodiment by adjusting the ratio between total cross-sectional area of the fuel radial direction channel 105 and the total cross-sectional area of the axial clearance 111. It will thus be understood that a needle valve type will operate similarly to the ball valve type described in the first embodiment.

In the present invention, a uniform distribution of fuel spray and drop size is obtained. Further, the fuel flow around the ball valve and at the downstream side thereof is stabilized and control of the injection flow amount is accurately effected. Additionally, since the generation of large fuel drops is suppressed, the quality of the fuel mixture supplied to the internal combustion engine is improved because small drops are vaporised faster, a stable and more efficient engine operation is achieved.

Having described the present invention it will be understood that as well as providing a uniform variation in distribution of fuel spray and drop size through averaging a local drop diameter distribution and mean drop diameter, further an electro-magnetic fuel injection valve capable of a stable flow rate control is provided.

Although the invention has been described in relation to an electro-magnetic fuel injection valve it is to be understood that the invention is not to be so limited and can be applied to other types of injector such as mechanical and hydraulic types.

It is to be understood that various modifications may be made and that all such modifications falling within the spirit and scope of the appended claims are intended to be included in the present invention.

We claim:

1. A fuel injection valve comprising a valve seat upstream from an injection port, a reciprocal valve member for contacting said seat to open and close said injection port, said valve member being circular in cross-section, an annular clearance provided between the valve member and a body member portion upstream from said seat, an axial fuel passage in the direction of reciprocation for producing substantially non-swirling fuel to the injection port, and a transverse passage for introducing swirling fuel to the injection port, whereby the swirling and non-swirling fuel is ejected by the injection port.

2. A fuel injection valve as claimed in claim 1 wherein the direction of reciprocation has a longitudinal axis and a transverse axis perpendicular to said longitudinal axis, and the transverse passage (8) is offset from said transverse axis.

3. A fuel injection valve as claimed in claim 2 wherein the transverse fuel passage is upstream from the valve seat.

4. A fuel injection valve as claimed in claim 3 wherein said transverse fuel passage communicates with said axial fuel passage at a spaced upstream location from said valve seat.

5. A fuel injection valve as claimed in claim 2 wherein four equiperipherally spaced transverse fuel passages are provided.

6. A fuel injection valve as claimed in claim 1 wherein the cross-sectional area of the transverse fuel passage (Am) is arranged to be greater than the cross-sectional area of the annular clearance (Ag).

7. A valve as claimed in claim 6 wherein $1.5 < Am/Ag < 6.0$.

8. A fuel injection valve as claimed in claim 2 wherein the distance of offset of the transverse fuel passage is in the range 0.5 mm to 1.0 mm.

9. A fuel injection valve as claimed in claim 1 wherein the valve member is one of a needle valve and a ball valve.

10. A fuel injection valve as claimed in claim 1 wherein the valve member is actuable by an electromagnetic coil assembly.

11. A fuel injection valve including a valve member having a seating portion arranged to be controllably movable in an axial direction toward and away from a circular valve seat for controlling fuel flow from a port downstream of said valve seat, said valve member being circular in cross-section, an annular clearance provided between the valve member and a body portion upstream from said valve seat, a generally axial fuel passage extending from upstream of the fuel member through a clearance between said seating portion and said seat for producing a substantially non-swirling fuel flow from said port, and a transverse fuel passage extending transversely to said axial direction and communicating with said fuel passage at the location of said annular clearance and at a location offset to a diameter of the valve seat for producing a swirling fuel flow from said port, whereby a combination of swirling and non-swirling fuel flow is supplied by said port.

12. A fuel injection valve comprising a valve seat upstream from an injection port, a reciprocal valve member for contacting said seat to open and close said injection port, said valve member being circular in cross-section, an annular clearance provided between the valve member and a body member upstream from said seat, an axial fuel passage in the direction of reciprocation for producing substantially non-swirling fuel to the injection port, and a transverse passage for introducing swirling fuel to the injection port, the cross-sectional area of the transverse fuel passage (Am) being arranged to be greater than the cross-sectional area of the annular clearance (Ag), whereby the swirling and non-swirling fuel is injected by the injection port.

13. A valve as claimed in claim 12 wherein $1.5 < Am/Ag < 6.0$.

14. A fuel injection valve as claimed in claim 12 wherein the direction of reciprocation has a longitudinal axis and a transverse axis perpendicular to said longitudinal axis, and the transverse passage is offset from said transverse axis.

15. A fuel injection valve as claimed in claim 14 wherein the transverse fuel passage is upstream from the valve seat.

16. A fuel injection valve as claimed in claim 15 wherein said transverse fuel passage communicates with said axial fuel passage at a spaced upstream location from said valve seat.

17. A fuel injection valve as claimed in claim 14 wherein four equi-peripherally spaced transverse fuel passages are provided.

18. A fuel injection valve as claimed in claim 14 wherein the distance of offset of the transverse fuel passage is in the range 0.5 mm to 1.0 mm.

19. A fuel injection valve as claimed in claim 12 wherein the valve member is one of a needle valve and a ball valve.

20. A fuel injection valve as claimed in claim 12 wherein the valve member is actuable by an electromagnetic coil assembly.

21. A fuel injection valve having a valve seat upstream from an injection port, a reciprocal ball valve for contacting said seat to open and close said injection port, an annular clearance between the ball valve and a body portion upstream from said seat, an axial fuel passage in the direction of reciprocation for producing substantially non-swirling fuel to the injection port, and a transverse passage for introducing swirling fuel to the injection port at the location of said annular clearance, whereby the swirling and non-swirling fuel is ejected by the injection port.

* * * * *